US007658448B2

(12) United States Patent
Birk et al.

(10) Patent No.: US 7,658,448 B2
(45) Date of Patent: Feb. 9, 2010

(54) ADJUSTABLE CHAIR CONSTRUCTION

(75) Inventors: Kåre Birk, Skanderborg (DK); Flemming Møller, Horsens (DK)

(73) Assignee: R82 A/S, Gedved (DK)

( * ) Notice: Subject to any disclaimer, the term of this patent is extended or adjusted under 35 U.S.C. 154(b) by 192 days.

(21) Appl. No.: 11/791,819

(22) PCT Filed: Nov. 29, 2005

(86) PCT No.: PCT/DK2005/000761

§ 371 (c)(1),
(2), (4) Date: Aug. 21, 2007

(87) PCT Pub. No.: WO2006/056209

PCT Pub. Date: Jun. 1, 2006

(65) Prior Publication Data

US 2007/0296259 A1 Dec. 27, 2007

(30) Foreign Application Priority Data

Nov. 29, 2004 (DK) ..... 2004 01861

(51) Int. Cl.
*B60N 2/00* (2006.01)
*A47C 7/02* (2006.01)

(52) U.S. Cl. ..... 297/354.12; 297/452.4; 297/361.1

(58) Field of Classification Search ..... 297/354.12, 297/361.1, 362, 366, 452.4
See application file for complete search history.

(56) References Cited

U.S. PATENT DOCUMENTS 4,805,961 A 2/1989 Garrod et al.
5,435,624 A * 7/1995 Bray et al. ..... 297/362.11
5,681,084 A * 10/1997 Yoneda ..... 297/284.9
5,713,632 A * 2/1998 Su ..... 297/312
6,033,017 A 3/2000 Elquadah et al.
6,145,930 A * 11/2000 Su ..... 297/367
6,460,933 B1 * 10/2002 Bors et al. ..... 297/440.2
6,776,454 B1 8/2004 Aubert et al.
6,926,363 B2 * 8/2005 Yamashita ..... 297/366
7,500,719 B2 * 3/2009 Kojima ..... 297/362

FOREIGN PATENT DOCUMENTS

| | | |
|---|---|---|
| DE | 851113 | 10/1952 |
| DE | 1034990 | 7/1958 |
| EP | 0885605 | 12/1998 |
| FR | 2690880 | 11/1993 |
| FR | 2860460 | 4/2005 |
| GB | 927045 | 5/1963 |
| WO | WO 02/085664 | 10/2002 |

* cited by examiner

*Primary Examiner*—Sarah B McPartlin
(74) *Attorney, Agent, or Firm*—James Creighton Wray; Meera P. Narasimhan

(57) ABSTRACT

An adjustable chair construction is described which is particular in that the backrest is linked to the seat by means of at least one hinge construction, where said hinge construction on the seat comprises at least one first projecting member (23) having a curved or linear top section on which top section teeth are arranged, and on the back rest at least one second projecting member (82) having a curved or linear top section on which top section teeth are arranged, such that the teeth on one section mesh with the teeth on the other section, and that at least one connecting member (100) being pivotable fastened to the first and second projecting members (23, 82) maintains the teeth of the curved sections in meshed relationship.

16 Claims, 6 Drawing Sheets

ADJUSTABLE CHAIR CONSTRUCTION

This application claims the benefit of Danish Application No. PA 2004 01861 filed Nov. 29, 2004 and PCT/DK2005/000761 filed Nov. 29, 2005, which are hereby incorporated by reference in their entirety.

FIELD OF THE INVENTION

The present invention relates to an adjustable chair construction.

BACKGROUND OF THE INVENTION

In the art, a number of adjustable seat constructions exist which makes it possible to adjust the backrest in relation to the seat, the height of the backrest in relation to the level of the seating surface, and in some instances also the width of the seat and/or backrest in relation to the user.

A number of these prior art chair constructions only makes it possible to adjust one or a few of the features of the chair construction. For people of normal built, this is usually not a problem, but especially for handicapped users there is a need to be able to adjust the chair perfectly in order to provide the most comfortable seating position for the user. This even more so as handicapped persons often will be forced to spend longer periods of time in a chair than normal persons, who can leave the chair for a while and then return.

Especially for chair constructions in wheelchairs suitable for persons having handicaps which necessitate the provision of further supports such as leg supports on the sides as well as back supports, chest supports, shoulder supports and the like, the requirements relating to the adjustability of the chair construction are greatly increased. Usually, this has been addressed in the art by providing one-off special constructions, especially suited for the user in question. This in turn is a very costly and resource-demanding process. In particular, when the one-off construction is made for children, a further problem arises as the child grows, in that the one-off especially produced chair for the child at one size will, as the child grows, become more and more of a compromise, and at a certain time it is necessary to have a further chair built in order to address the needs of the child having outgrown the original chair.

An additional problem especially relating to chair constructions for the handicapped is that they usually have one or more extra supports mounted, for example on the backrest, in order to provide relief for the user during use. By reclining the backrest in relation to the seat in a traditional wheelchair, or in chair constructions as for example suggested in NL 7115696, the additional supports arranged either on the backrest or the seat construction are displaced due to the fact that the pivot point of the backrest in relation to the seat does not follow the actual movement of the back in relation to the seat of the user.

Consequently, there is a need for providing an adjustable chair construction which alleviates at least the problems described above.

OBJECT OF THE INVENTION

The present invention addresses this by providing an adjustable chair construction which is particular in that the backrest is linked to the seat by means of at least one hinge construction, where said hinge construction on the seat comprises at least one first projecting member having a curved or linear top section on which top section teeth are arranged, and on the back rest at least one second projecting member having a curved or linear top section on which top section teeth are arranged, such that the teeth on one section mesh with the teeth on the other section, and that at least one connecting member being pivotable fastened to the first and second projecting members maintains the teeth of the curved sections in meshed relationship.

For this construction, the pivot point between the backrest and the seat translates during the movement such that by designing the curved or linear top sections of the projecting members, it is possible to follow the movement of the back in relation to the seat.

As a person reclines the backrest, or puts it back up into the normal position, a point on the back of the person does not describe a circular arch. This is due to the fact that the movement of the back in relation to the seat will describe a rolling motion as the pivoting action, i.e. bending of the back in relation to the seat, occurs by a slight rolling on the buttocks. For this reason, traditional reclining backrests have a tendency to push on the backside of the person sitting in the chair, and thereby also the additional equipment such as side supports, neck support and the like will be displaced in relation to their optimum placing. However, with the inventive construction of the hinge between the seat and the backrest, this displacement is avoided such that also by reclining the backrest, the extra equipment such as side supports, backrests and the like, will be maintained in the same position in relation to the person with the movement of the backrest.

The curved top section or linear top section may be designed according to the size of the user such that for example for small children one size is suitable, whereas for older children and young persons other curves or linear top sections may be preferred.

By further providing teeth on both projecting members which intermesh it is avoided that one projecting member is displaced in relation to the other member. Hereby, it is assured that a firm, decisive, and well-defined displacement of the pivot point is assured under all circumstances.

The functioning of the teeth is to avoid slippage between the two projecting members. It should, however, be understood that the teeth may be replaced by other means, which means will provide the same security against slippage as the preferred embodiment. The underlying principle, therefore, may be seen as providing sufficient friction in order to avoid slippage between the two projecting members.

In a further advantageous embodiment of the invention the seat may be adjusted in width, length and angulations, and that the means for adjusting the seat comprise:

- a base plate, which base plate may be fastened to a substructure such as a wheelchair chassis, car seat or the like, and that at least one elongated aperture is arranged perpendicular to the seats back/front direction;
- two mirror image separate hinge plates arranged on top of the base plate, where each hinge plate comprises at least one hole, through which hole the hinge plate may be slidingly engaged with the elongated aperture provided in the underlying base plate, and that further first and second elongated apertures orientated in the front/back direction of the seat are provided, and optionally a projecting member comprising the curved or linear top section is arranged adjacent an outer side edge of said hinge plate;
- two mirror image wing members arranged on top of the hinge plates, where each wing member comprises a hole, through which hole the wing member may be slidingly engaged with the first elongated aperture of the underlying hinge plate, and an elongated aperture optionally curved, arranged at an angle in relation to the front/back direction of the seat, whereby the wing member may pivot in a plane substantially parallel to the plane of the base plate about the hole, guided by a sliding engagement member connecting the elongated aperture in the wing member with the second elongated aperture in the hinge plate, and that optionally adjacent an outer side edge an upstanding support member is provided;

two mirror image cover plates arranged to cover at least a part of the wing member, and that said cover plate is connected to the hinge plate.

This very versatile and extremely flexible seat constructions allows for a complete fitting of the seat to the individual user, and furthermore allows the seat to expand with the user such that it is not necessary to compromise on comfort as the user grows bigger, for example as the child grows older. This is achieved by the fact that the seat is built as a layered construction, where the plate or plates in each layer have different functions relating to the support of the user, and may be adjusted independently of the rest of the construction such that even users having special requirements relating to support and seating capabilities may be accommodated by the present invention.

By providing the elongated apertures, whereby two plates may be displaced in relation to each other, or pivoted in relation to each other, a very stable and reliable construction is achieved.

The base plate is, furthermore, the interface of the support structure such as for example the wheel chassis, or car seat, and may be equipped with suitable means for attaching the seat to the underlying structure. These means depend on the use, and especially the particular use of the seat, and is outside the scope of the present invention. Therefore, by providing a versatile seat construction according to this embodiment, a very flexible chair is provided which may grow with the user, or which may easily be adapted to other users by simply utilizing the means built into the inventive layered construction. As the seat is expanded or retracted, the only part which needs to be especially adapted is the cushion which is usually placed on top of the seat construction. Providing a tailor-made cushion, however, is a substantial saving in comparison to replacing the entire chair construction.

In a further advantageous embodiment of the invention the backrest comprises:

a column member;

a central back rest support, which may be a separate member slidingly attached to the column or an integral part of the column member;

a connection bridge which may be a separate member attached to the column or an integral part of the column member, where said connection bridge comprises parts extending sideward from the column, and that the sideward parts comprises a number of apertures;

one or more hinge members, comprising elongated slots, such that the hinge parts may be slidingly engaged with the sideward parts of the connection bridge, and further that a projecting member having a curved or linear top section on which top section teeth are arranged is provided on each hinge member;

two mirror image side plates comprising elongated slots through which the side plates may be slidingly attached on either side of the central back rest support.

As it is the case with the inventive seat construction as described above, also the inventive backrest construction according to the present invention comprises a number of possibilities for adjusting the backrest such that it will be able to provide support for users having different sizes.

The flexible construction of the inventive backrest according to the invention may, as suggested above, be made from a number of separate parts. An advantage, for example, of having a separate column member is the fact that for smaller users, a smaller column member may be advantageous in that the height displacement requirements to the back support as a whole may be eliminated due to the relatively small size of the user. On the other hand, when larger users having longer backs need to be accommodated, the seat may be adapted by simply replacing one column member by a longer column member such that the back may be adjustable into the most comfortable position for the actual user. In other instances, it might be advantageous to integrate the central back rest support into the column in order to achieve a construction comprising fewer parts, and thereby a lighter, and possibly cheaper, construction.

One disadvantage of having a number of mutually adjustable parts is the fact that especially when chair constructions are used with children, the children may have a tendency to fiddle with the adjustment means such that the chair from time to time needs to be readjusted. However, the adjustment means may be in the shape of bolts, screws or the like, which require special tools in order to loosen, and thereby manipulate, the adjustable features in order to hamper the tendency of the children to fiddle with the chair. These problems are altogether avoided when the items are presented as integral items such as it for example may be the case with the column member and the backrest support.

The invention, however, foresees that both embodiments, i.e. integral and separate parts for a number of the parts, may be advantageous in their own right depending on circumstances, and the use of the inventive adjustable chair construction.

The connections bridge is the link between the inventive seat construction and the backrest construction in that the hinge members comprising the projecting members having curved or linear top sections are an integral part of the hinge members. Thereby, the relative movement and displacement of the entire backrest construction is translated through the hinge members to the connection bridge due to the movement of the entire backrest. In order to allow for a wider seat construction, the hinge members may advantageously be provided with elongated slots such that they may be displaced sideways in relation to the connection bridge.

Also in order to take into account the wider backs of larger persons, the side plates may be attached to the central backrest support by means of bolts, screws or the like, such that elongated apertures are provided either in the central backrest support, or in the side plates such that these parts may be displaced in relation to each other in order to account for a wide or narrow back. Furthermore, in the side plates, further elongated apertures or holes may be provided in order to fasten auxiliary equipment such as for example side supports for the back, arm rests, shoulder rests, neck rests or other standard equipment used depending on the handicap of the user.

In a further advantageous embodiment of the invention the distance between the pivotable fastening points of the connecting member is between 50 mm and 150 mm, more preferred between 75 mm and 125 mm, and most preferred between 90 mm and 110 mm, and that at least one of the top sections on the projecting members has a circular shape, where said circle has a radius in the range 25 mm to 100 mm, more preferred 45 mm to 75 mm, and most preferred 50 mm to 60 mm.

For practical reasons, an adjustable chair construction having a hinge within the above mentioned ranges provides for the appropriate displacement of the backrest in relation to the seat for a wide range of user sizes. At the same time maintaining the construction within the limits provides for a very stable, user-friendly as well as long-lasting construction such that, despite of the many possibilities for adjusting the chair construction, a very firm, rigid and reliable chair construction is provided.

In a still further advantageous embodiment, the backrest is in a normal position in relation to the seat, i.e. approximately 90 degrees, the vertical distance between the pivotable fastening points of the connecting member is 50 mm to 100 mm, more preferred 65 mm to 80 mm, and most preferred 70 mm to 75 mm.

The vertical distances are very important in that, due to the special needs of some users, it must be possible, in addition to the adjustment means already built into the chair construction, to provide a cushion both in the seat construction, but also in the backrest which incorporates special support or relief zones. For the adjustable chair construction to be able to accommodate such special needs, it is advantageous that the projecting members, and thereby the positioning of the pivotable fastening points allow for these cushions, but at the same time a firm and rigid construction must be maintained.

Although the adjustable chair construction may be made from any suitable material, it is especially advantageous that the majority of the parts are made from moldable plastic materials. Alternatively, the column member as well as the base plate may be made from an aluminium material in order to provide the desired rigidity. The connecting member between the two hinge members may advantageously be made from a steel material, especially preferred from stainless less. By choosing these types of materials it is achieved that it is possible to fairly easily clean and maintain high hygienic standards for chairs of this type which is very important as the users usually spend a substantial amount of time in the chair constructions.

In a further advantageous embodiment of the invention, additional guide means are arranged between the base plate and hinge plates, where the guide means comprises at least one ridge or groove in the base plate and a complimentary groove or ridge in the hinge plate, such that the hinge plates may slide sideways guided by the interaction of the groove and ridge.

Although the relative displacement of the hinge plates in relation to the base plate to a certain degree is determined by the positioning of the one or more elongated apertures in the base plate, the guide means in this further embodiment may serve to stabilize the movement, and help provide a more exact linear movement. This is important in that together with a hinge plate, the projecting hinge members are also displaced, and in order to maintain a substantially free movement of the backrest in relation to the seat, the alignment of the projecting members integral with the hinge plate is very important.

DESCRIPTION OF THE DRAWING

The invention will now be explained with reference to the accompanying drawing, wherein.

DETAILED DESCRIPTION OF THE INVENTION

Figure 1:
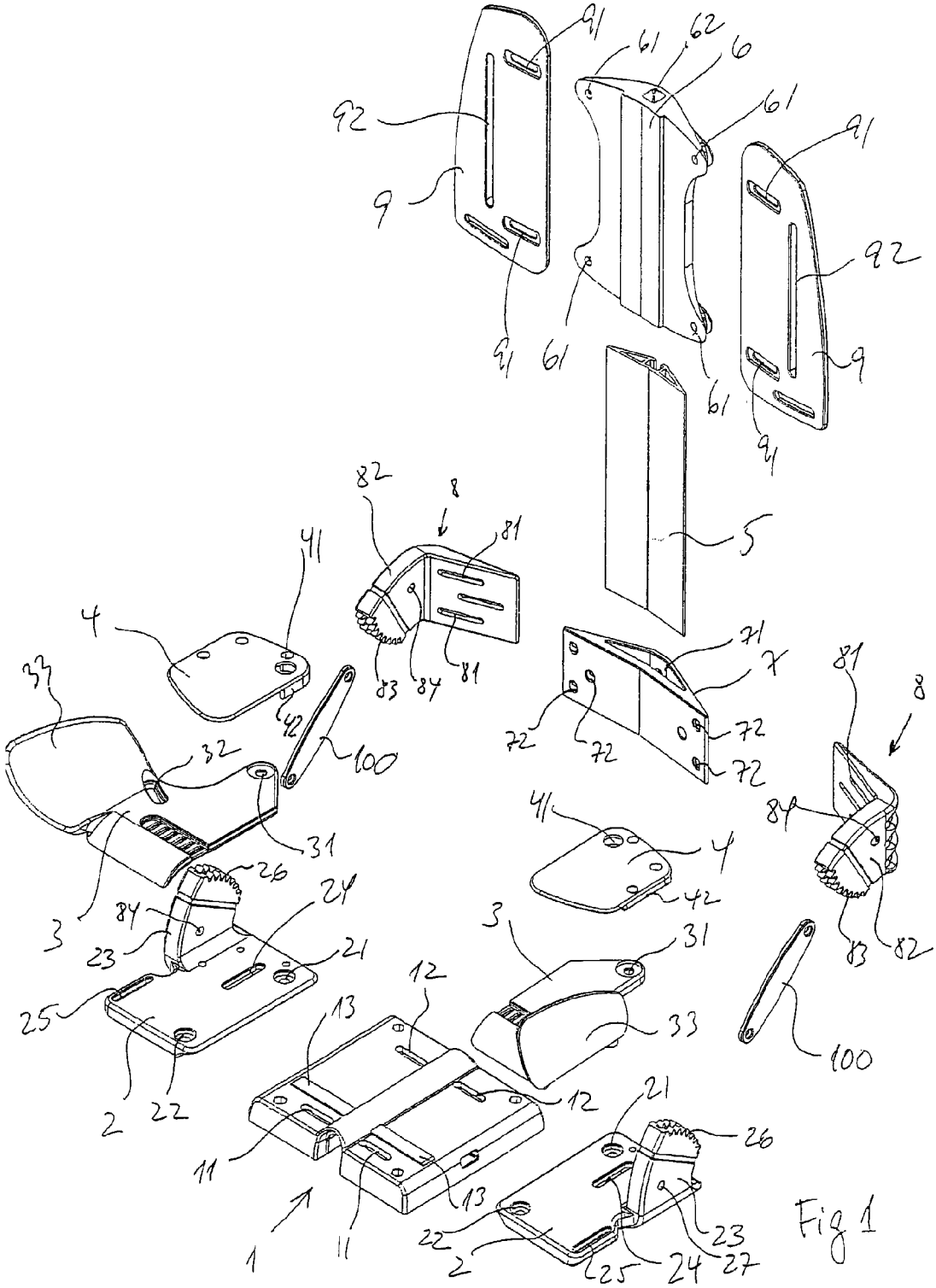
FIG. 1 illustrates an exploded view of the adjustable chair construction.

In FIG. 1 is illustrated the main components in order to provide the full flexibility and adjustability of a chair construction according to the invention. In this context, however, it should be noted that it is possible to use only the flexibility of the seat construction without the flexibility of the backrest and vice versa. However, for the sake of illustration, the following detailed description will contemplate a chair construction comprising all the adjustable features of the inventive chair construction.

Padding, cushions and the like have not been illustrated for clarity reasons.

The seat construction comprises a base plate 1. On top of the base plate, two mirror image hinge plates 2 are placed. On top of the hinge plates, two mirror image wing members 3 are placed which may slide in relation to the hinge plates, and also pivot in relation to both the hinge plates and the base plate. Finally, in order to cover the gap which may otherwise be un-bridged between the wing members 3 and the base plate 1, or the hinge members 2, cover plates 4 are provided on top of this layered construction. These four main components constitute the different layers in the layered adjustable seat construction, and the relative movements of the different parts 1-4 will now be explained.

Centrally in the longitudinally direction of the base plate 1 is provided a "half-tunnel". This half-tunnel is provided in order to arrange connection means between the base plate 1 and the back rest construction. In preferred embodiments an adjustable gas spring, articulately connected between the base plate and the back rest construction, is preferred in that it maintains the back rest in a substantially fixed position in relation to the base plate, and at the same time the connection may exhibit a certain resiliency which provides added comfort for the user. Well proven constructions exist which may be implemented within the scope of the present invention, in that the half-tunnel may be designed according to the chosen system.

Base plate 1 is foreseen as being mountable to a further structure, for example the chassis of a wheelchair, by any suitable means. The hinge plates 2 will be fastened by bolts (not illustrated) through the holes 21,22 to the base plate such that the bolts penetrate the holes 21,22, and further penetrate the elongated apertures 11,12 in the base plate. In this manner, it is possible to slide the bolts arranged in the holes 21,22 in the elongated apertures 11,12 in order to adjust the relative distance between the projecting members 23 constituting half the hinge construction.

In order to further guide this movement of the hinge plates 2 in relation to the base plate 1, a ridge 13 has been provided in the base plate. A corresponding groove (not illustrated) is provided in the underside of the hinge plates 2 such that the groove interacts with the ridge 13 in order to provide for a substantially linear movement sideways of the hinge plates 2 in relation to the base plate 1. When the actual desired position of the hinge plates in relation to the width of the seat is achieved, the positions may be maintained by fastening the bolts, and thereby creating a firm engagement between the hinge plate 2 and the base plate 1.

In order to be able to adjust the length of the seat and the width of the seat along the front edge of the seat, the wing plates 3 are provided on top of the hinge plates 2. The wing plates 3 are by means of bolts (not illustrated) passed through the holes 31 fastened to the hinge plates in the elongated apertures 24 such that the wing plate 3 may be moved longitudinally in the elongated aperture 24 in order to adjust the length of the seat. In order to adjust the width of the seat, especially along the front edge, the wing plates 3 may be pivoted about a bolt passed through the hole 31 guided for movement by the extent of the further elongated, optionally curved, aperture 32. By passing a bolt through the aperture 32, and through the elongated aperture 25, the wing plate may be angled in relation to the hinge plate, and thereby the width of the seat, especially along the front edge, may be expanded. The longitudinal adjustment will, therefore, as explained above be regulated by the two elongated apertures 24,25 by means of the bolts passed through the hole 31 and the aperture 32.

In circumstances where the wing plate 3 is pushed forwards, the rear section of the hinge plate is exposed such that a step equal to the material thickness of the wing plate 3 is present in the rear end of the hinge plate 2. In order to bridge this step, a cover plate 4 is provided. The cover plate 4 is fastened to the seat construction, for example by the same bolt which fixes the hinge plate 2 to the base plate 1. Therefore, a hole 31 is provided such that the bolt may be passed through the hole 41,21 and the elongated recess 12 in the base plate 1. The cover plate 4 is, furthermore, provided with a step 42 which step serves to compensate for the material thickness of the wing member 3.

In this manner, a layered seat construction is provided where the seat surface may be configured individually to the user by utilizing the many adjustment possibilities built into the layered seat construction.

The backrest construction comprises a column member 5 which in the illustrated embodiment is a separate member. The column member 5 may, however, be an integral part of the central backrest support 6, which also in this embodiment is illustrated as a separate member. The column member fits inside a correspondingly shaped cavity provided inside the central backrest support, such that the backrest support 6 may be displaced in the longitudinal direction of the column member 5. In this manner, the height of the backrest support may be adjusted.

Figure 4:
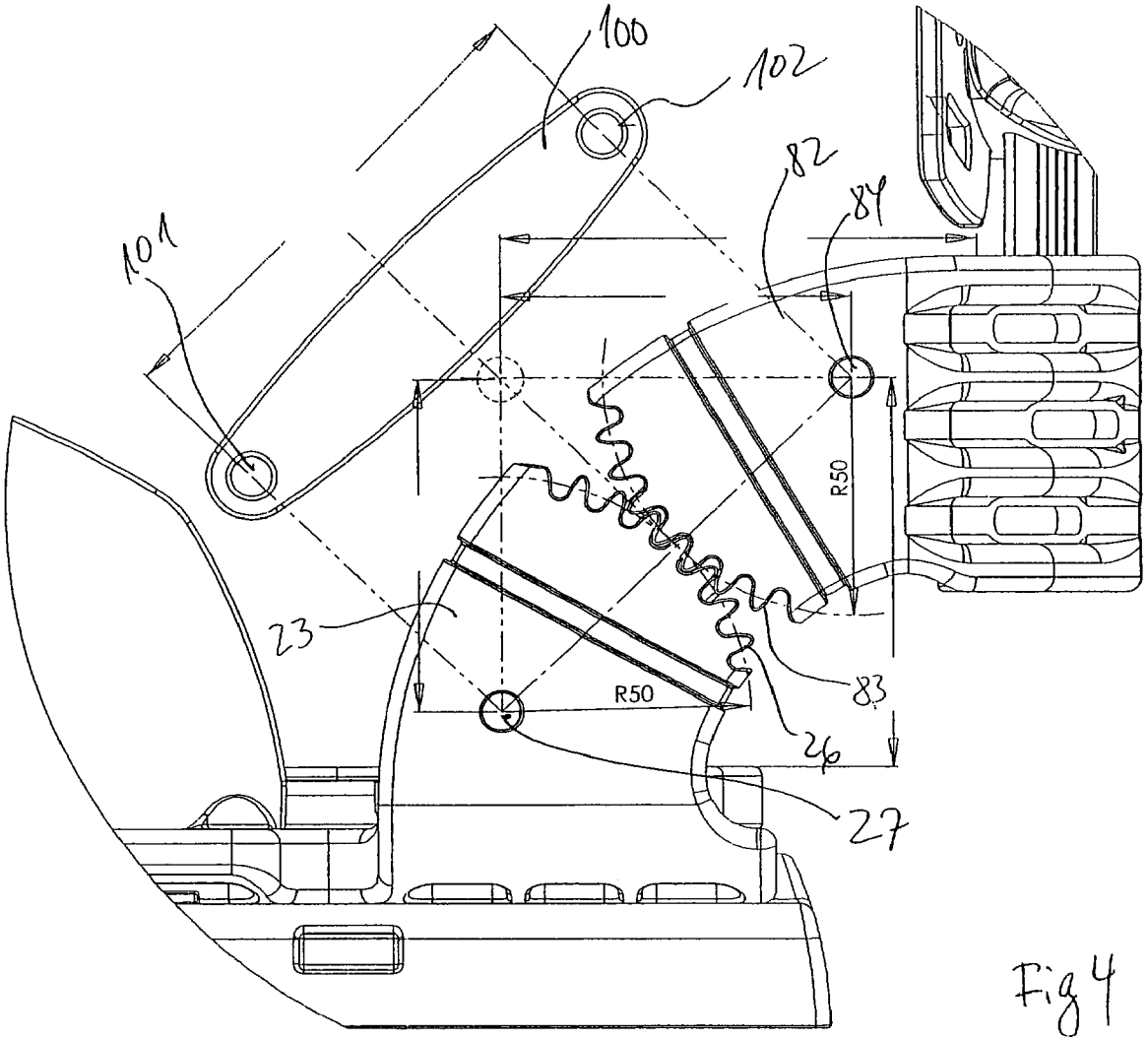
FIG. 4 illustrates details of a hinge construction.

A connection bridge 7 is provided in the lower section of the column member 5. Also, the connection bridge may optionally be an integrated part of the column member 5. The connection bridge 7 is in this embodiment provided with a cavity 71 having a shape corresponding to the cross-section of the column member 5 such that the connection bridge 7 may be arranged outside and around the column member 5. To the connection bridge 7, hinge members 8 be may fastened by means of bolts through the elongated apertures 81 provided in the hinge members 8, and the holes 72 provided in the connection bridge 7. By displacing the hinge members 8 sideways in relation to the connection bridge 7 in the elongated apertures 81, the width of the connection between the backrest and the seat construction may be adjusted. The hinge members further comprise projecting members having curved or linear top surfaces which will be explained with further detail in reference to FIG. 4.

In order to provide a backrest having an adjustable width, two mirror image side plates 9 are provided. The side plates 9 may be moved sideways in relation to the central backrest support 6 by sliding the side plates 9 in relation to the backrest support 6 along the elongated apertures 91 through which bolts (not illustrated) may be passed through the holes 61. In this manner, a fully flexible and adjustable backrest is provided. The further elongated apertures 92 provided in the side plates 9 may serve to fasten further auxiliary equipment such as sideways support or the like, which for special users may be necessary in order to provide a comfortable supporting structure of the chair construction. Also, neck supports, head supports and the like may be arranged, either in the elongated apertures 92 provided in the side plates 9, or in the aperture 62 provided in the central backrest support 6.

In order to connect the backrest with the seat construction, a hinge construction comprises projecting members 23,82 in either side is provided. The teeth 26,83 on either projecting member are arranged to intermesh such that relative slip between the two projecting members 23,82 is avoided. In order keep the two projecting members together, a connecting member 100 is provided. The connecting member 100 is pivotable fastened to the projecting member 23,82 by for example pins (not illustrated) or any other suitable means which will create a pivotal fastening point 27,84 in the projecting members 23,82. The functioning of the projecting members as well as the connection member 100 will be further explained with reference to FIG. 4.

Figure 2:
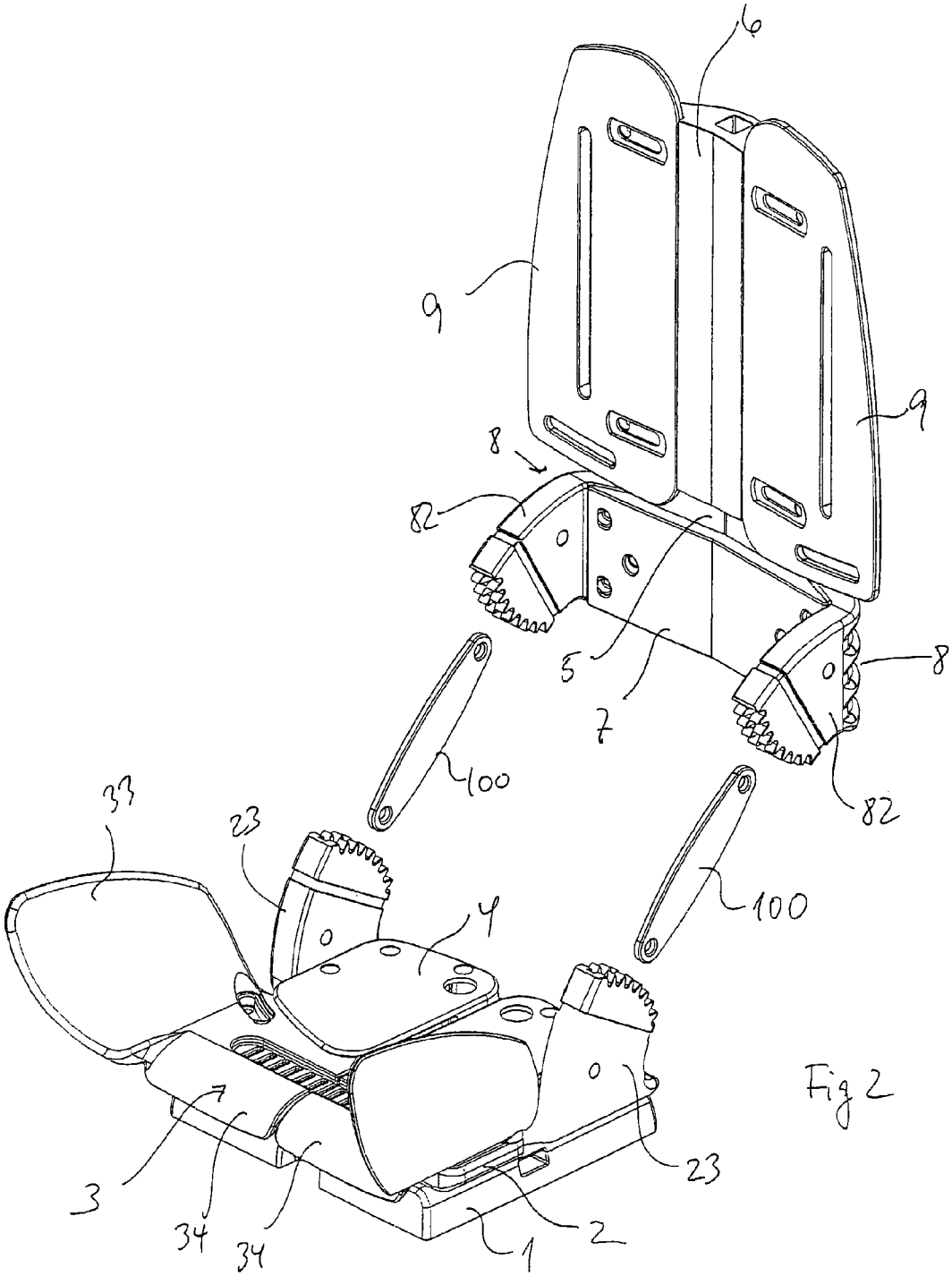
FIG. 2 illustrates an assembled seat and an assembled backrest construction.

Turning to FIG. 2, the assembled layered structure of the seat as well as the backrest is illustrated. The reference numbers of the features are the same as in FIG. 1. Only the main members are foreseen with reference numbers.

Figure 3:
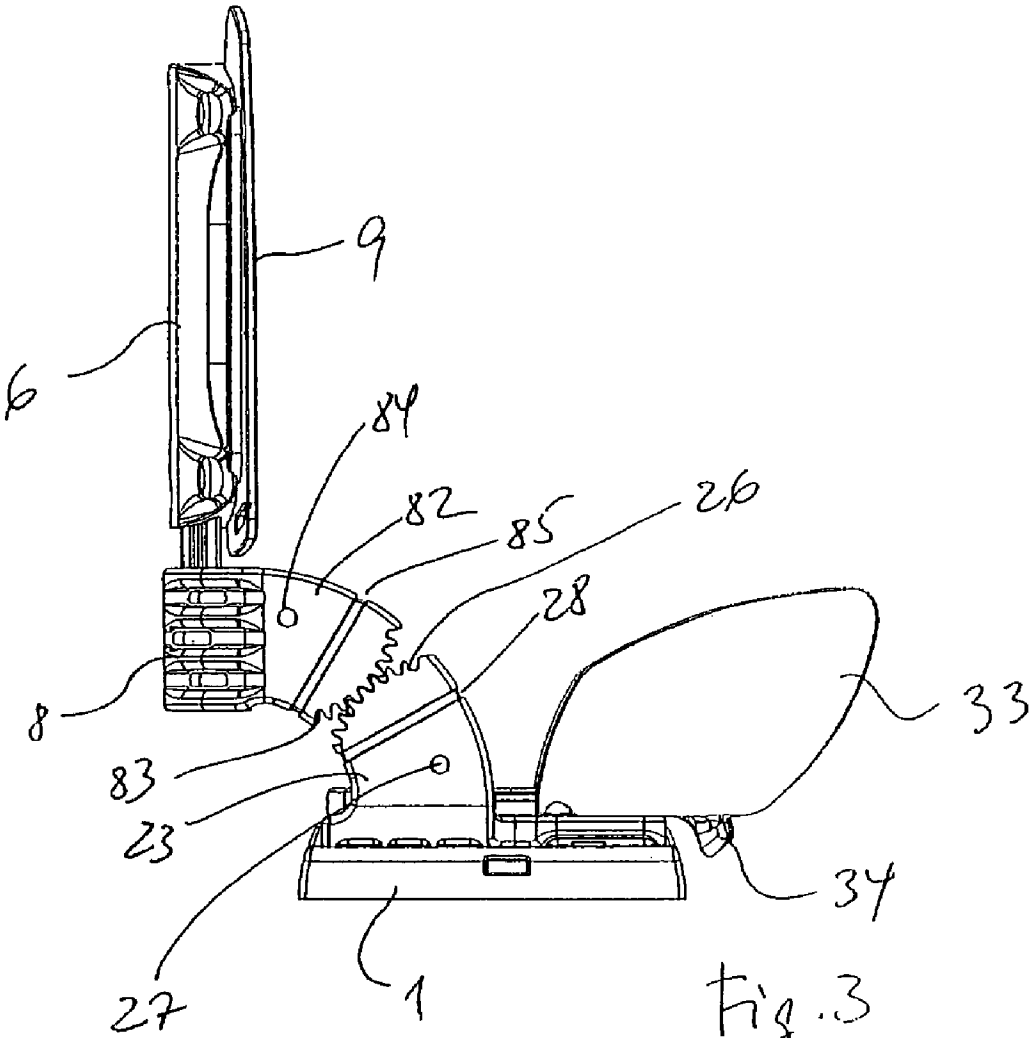
FIG. 3 illustrates a side view of an assembled adjustable chair construction.

Turning to FIG. 3, a side view of a chair construction according to the invention is illustrated. As may be seen quite clearly in this view, the wing members 3 may be provided with upstanding supports 33. These upstanding supports provided in both sides serve to maintain a user inside the chair, and thereby provide sideways support for a person. Also, in order to improve the comfort, the front edge 34 of the wing member may be curved such that the seating comfort is improved. In both projecting members 23,82 a groove 28,85 is provided in this embodiment. This groove serves to fit a rubber member (not illustrated) which will cover the teeth such that users will not be able to get their fingers in-between the teeth or have pieces of clothing or the like stuck in the intermeshing teeth 26,83. When the chair construction is assembled, the connection member is inserted in a cavity provided in the central part of the projecting members 23,82 such that the connection member 100 is completely maintained inside the projecting members 23,82. The cavities inside the projecting members 23,82 must be large enough to allow movement of the connecting member 100 inside the projecting members 23,82. The connection member is connected by the pivotable fastening points 27,84 such that, as the backrest is pivoted in relation to the seat, the movement of the backrest will be a type of rolling on the curved or linear top sections provided with teeth 26,83 as illustrated. In the illustrated embodiment, as is evident from the close-up view in FIG. 4, the top sections are provided with teeth along a circular curve, in this embodiment having a radius of 50 mm. Although the connecting member 100 is illustrated outside the projecting members 23,82, this is for illustration purposes only in that the connecting member 100 is fastened to the pivot points 27,84 by inserting pins (not illustrated) through the holes 27,84 and the corresponding holes 101,102 provided in the connection member 100 such that a firm connection is made between the backrest construction and the seat construction by means of the connection member 100.

By designing the top sections of the two projecting members it is possible to achieve that the pivotable movement between the backrest and the seat will be a rolling movement such that the backrest will follow the movement of the back in relation to the seat. Research has shown that by designing and constructing the curves of the projecting members' top section, for example as illustrated, it is possible to provide a movement of the backrest which will follow the back's movement due to the rolling movement of the hips on the buttocks of the user. In this manner, no vertical displacement of the backrest will occur in relation to a user's back, as the backrest is reclined or moved into an upright position. This provides a number of advantages in relation to traditional hinges where the pivot point is either outside the alignment with the person's hip joint, or altogether outside the seat construction.

Figure 5:
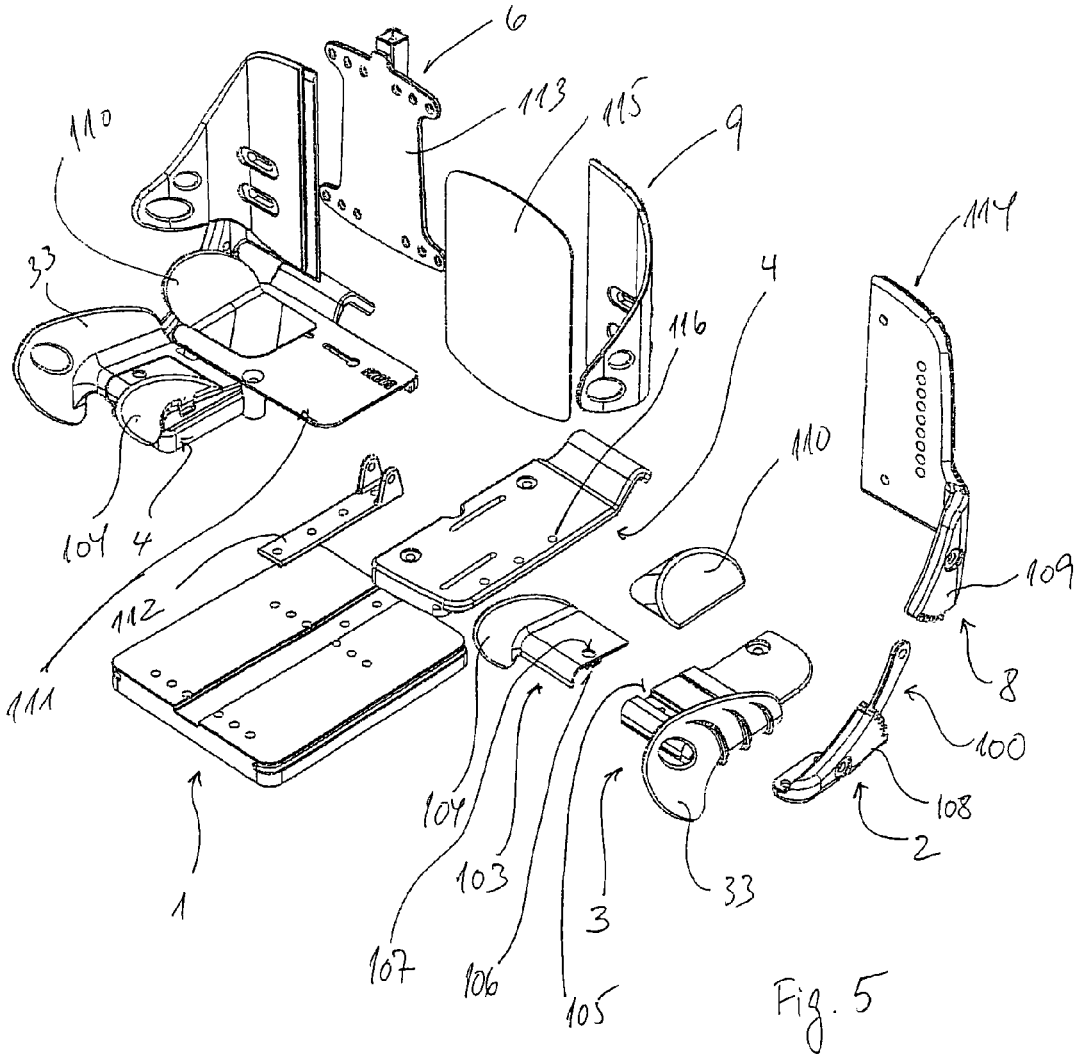
FIG. 5 illustrates another example of a seat construction according to the invention.

In FIG. 5, another example of a seat construction according to the invention is illustrated. As it is the case with the embodiment described with respect to FIGS. 1-4, the seat comprises a base plate 1, hinge plates 2, a seat wing plate 3, cover plates 4, hinge members 8, slide plates 9, a central backrest support 6 as well as the connecting member 100. The embodiment illustrated in FIG. 5 is assembled in a slightly different manner which provides for other/further possibilities for support for the user, as well as adjustment of the seat structure in relation to a user.

The wing plate members 3 are provided with a second cover plate 103, which cover plate 103 comprises a upstanding support 104. By arranging the secondary cover plate 103 slidably in the wing member 3, the upstanding supports 33, 104 will be able to provide sideways support for a leg of a user inserted between the two upstanding supports 33, 104. The secondary wing member 103 is slidably arranged in a groove 105 into which a corresponding tongue 106 may be fitted, and the two plates 33, 104 may be fixed in relation to each other by means of a bolt inserted through the aperture 107.

The hinge plates 2 have a slightly different configuration in that the curvature of the uppermost edge of the two connecting hinge parts 108, 109 are curved oppositely to the hinge parts 23, 82 as illustrated with reference to FIGS. 1-4. The curvature plus the slimmer design provide a number of advantages. The slim design of the hinge and the curvature of the hinge construction 108, 109 which is provided as low as possible in relation to the base plate, is provided in order for a helper to be able to guide a user in the seat in the hip region. The construction according to the embodiment depicted in the FIGS. 1-4 provides a sideways support for a user in the chair construction, but does not allow access to the user's hip region from a helper, or this access may only be gained in a troublesome manner.

The hinge plates 2 are fastened to the cover plates 4. In the cover plates, a plurality of holes 116 for fastening of the hinge plates is provided. Thereby, the possibility of displacing the seat in relation to the back rest is created, in addition to adjusting the length of the seat by means of the wing plates 3.

In order to provide hip support for a user, hip support plates 110 are provided. The hip support plates 110 are mounted on a cover plate 111, which cover plate may be fastened through the cover plate 4 to the base plate 1. By means of a ratchet attachment as well as an elongated aperture provided in the cover plate 111, the hip support plate 110 is slidably fastened to the cover plate 111.

As already explained above, the different parts of the adjustable seat are interconnected in a adjustable manner, mainly by means of elongated apertures and corresponding holes and bolts such that one member may be displaced in relation to another member in at least one direction, whether it be linear or along a curve. For the embodiments of the invention according to FIGS. 5 and 6, the same basic principles for adjusting the parts in relation to each other as mentioned with respect to the embodiments according to FIGS. 1-4 apply. For this reason, the detailed provisions for mutual displacement of parts will not be explained.

The back rest is constructed slightly different than the embodiment explained with respect to FIGS. 1-4 in that the adjustment means for the back rest are provided on the back rest itself, whereas with the embodiments according to FIGS. 1-4, the base plate is provided with room for a gas spring in order to allow the relative adjustment of the back rest in relation to the seat. In order to fasten the gas spring, a clamp 112 is fastened to the base plate 1 such that a gas spring may be fastened between the clamp and the back rest support 6 in order to allow pivoting of the back rest support in relation to the base plate 1. The gas spring in the embodiment according to FIG. 1-4 is arranged substantially horizontally, whereas the gas spring in the embodiment according to FIG. 5-6 is arranged parallel to the back rest.

The back rest support comprises a plate member 113 onto which the extended hinge members 114 comprising integral hinge parts 109 may be adjustably fastened in order to determine the overall width of the seat construction in that the hinge parts define the outermost sections of the seat construction. Onto the extended hinge members 114, the side plates 9 may be adjustably fastened such that both with respect to the height and the width, the back support and the accompanying cushion may be provided with the maximum amount of support in relation to a user. In order to cover the bolt connections allowing the adjustments, a cover plate member 115 is also provided.

Figure 6:
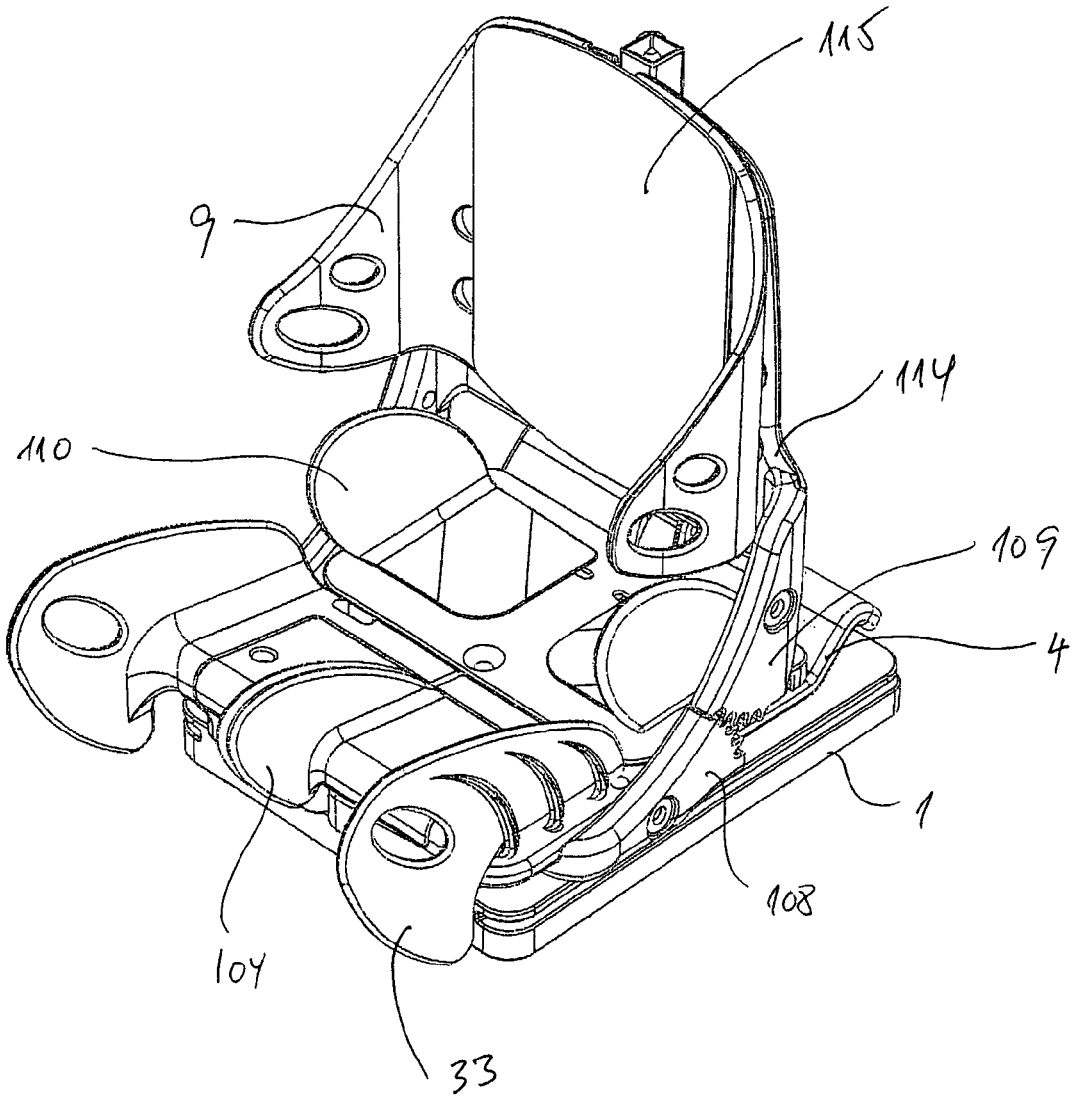
FIG. 6 illustrates an assembled seat according to the invention.

In FIG. 6, an assembled seat according to the invention is illustrated, where the main features of the invention are recognizable.

The invention claimed is:

1. An adjustable chair construction comprising a seat and a back rest, and where the back rest may be adjusted in relation to the seat, wherein the back rest is linked to the seat by means of at least one hinge construction, where said hinge construction on the seat comprises at least one first projecting member having a curved or linear top section on which top section teeth are arranged, and on the back rest at least one second projecting member having a curved or linear top section on which top section teeth are arranged, such that the teeth on one section mesh with the teeth on the other section, and that at least one connecting member being pivotally fastened by pivotable fastening points to the first and second projecting members, maintaining the teeth of the first and the second projecting members in meshed relationship, and that the seat may be adjusted in width, length and angulations, and means for adjusting the seat comprise:

a base plate, which base plate may be fastened to a substructure;

two mirror image separate hinge plates arranged on top of the base plate, where each hinge plate comprises at least one hole, through which hole the hinge plate may be engaged with the underlying base plate or an underlying cover plate; and two mirror image wing members, where each wing member comprises a hole, through which hole the wing member may be adjustably engaged with the underlying hinge plate or an underlying cover plate.

2. The adjustable chair construction according to claim 1 wherein:

the base plate comprises at least one elongated aperture arranged perpendicular to the seat's back/front direction;

that the two mirror image separate hinge plates are slidingly engaged with the elongated aperture provided in the underlying base plate, and that further first and second elongated apertures orientated in the front/back direction of the seat are provided, and optionally the at least one first projecting member comprising the curved or linear top section is arranged adjacent an outer side edge of said hinge plate;

where each wing member comprises a hole, through which hole the wing member may be adjustably engaged with the first elongated aperture of the underlying hinge plate, and an elongated aperture optionally curved, arranged at an angle in relation to the front/back direction of the seat, whereby the wing member may pivot in a plane substantially parallel to a plane of the base plate about the hole, guided by a sliding engagement member connecting the elongated aperture in the wing member with the second elongated aperture in the hinge plate, and that optionally adjacent an outer side edge an upstanding support member is provide; and two mirror image cover plates arranged to cover at least a part of the wing member, and that said cover plate is connected to the hinge plate.

3. The adjustable chair construction according to claim 1, wherein the back rest comprises:

a column member;

a central back rest support, which may be a separate member slidingly attached to the column or an integral part of the column member;

a connection bridge which may be a separate member attached to the column or an integral part of the column member, where said connection bridge comprises parts extending sideward from the column, and that the sideward parts comprises a number of apertures;

one or more hinge members, comprising elongated slots, such that the hinge members may be slidingly engaged with the sideward parts of the connection bridge, and further that the at least one second projecting member having a curved or linear top section on which top section teeth are arranged is provided on each hinge member; and two mirror image side plates comprising elongated slots through which the side plates may be slidingly attached on either side of the central back rest support.

4. The adjustable chair construction according to claim 1, wherein the distance between the pivotable fastening points of the connecting member is between 50 mm and 150 mm.

5. The adjustable chair construction of claim 4, wherein the distance between the pivotable fastening points of the connecting member is between 75 mm and 125 mm.

6. The adjustable chair construction of claim 4, wherein the distance between the pivotable fastening points of the connecting member is between 90 mm and 110 mm.

7. The adjustable chair construction of claim 4, wherein at least one of the top sections on the projecting members has a circular shape and wherein said circle has a radius in the range 25 mm to 100 mm.

8. The adjustable chair construction of claim 4, wherein at least one of the top sections on the projecting members has a circular shape and wherein said circle has a radius in the range 45 mm to 75 mm.

9. The adjustable chair construction of claim 4, wherein at least one of the top sections on the projecting members has a circular shape and wherein said circle has a radius in the range 50 mm to 60 mm.

10. The adjustable chair construction according to claim 1, wherein when the back rest is in a normal position in relation to the seat.

11. The adjustable chair construction of claim 10, wherein an angle between the back rest and the seat is approximately 90°.

12. The adjustable chair construction of claim 11, wherein a vertical distance between the pivotable fastening points of the connecting member is 50 mm to 100 mm.

13. The adjustable chair construction of claim 11, wherein a vertical distance between the pivotable fastening points of the connecting member is 65 mm to 80 mm.

14. The adjustable chair construction of claim 11, wherein a vertical distance between the pivotable fastening points of the connecting member is 70 mm to 75 mm.

15. The adjustable chair construction according to claim 1, wherein additional guide means are arranged between the base plate and the hinge plates, where the guide means comprises at least one ridge or groove in the base plate and a complimentary groove or ridge in the hinge plate, such that the hinge plates may slide sideways guided by the interaction of the groove and the ridge.

16. The adjustable chair construction of claim 1, wherein the substructure is selected from the group consisting of wheelchair chassis, car seats, and combinations thereof.

* * * * *